US006109857A

United States Patent [19]

Trygg

[11] Patent Number: 6,109,857

[45] Date of Patent: Aug. 29, 2000

[54] STACKABLE TRAY FOR HOLDING, DISPLAYING, AND TRANSPORTING A PLURALITY OF CONTAINERS AND LIFTING DEVICE AND METHOD OF HANDLING DIRECTED THERETO

[76] Inventor: Lars Erik Trygg, Box 243, S-374 24 Karlshamn, Sweden

[21] Appl. No.: 09/068,501

[22] PCT Filed: Nov. 13, 1996

[86] PCT No.: PCT/SE96/01466

§ 371 Date: May 12, 1998

§ 102(e) Date: May 12, 1998

[87] PCT Pub. No.: WO97/18141

PCT Pub. Date: May 22, 1997

[30] Foreign Application Priority Data

Nov. 15, 1995 [SE] Sweden ..... 9504068

[51] Int. Cl.[7] ..... B65D 1/24

[52] U.S. Cl. ..... 414/626; 294/98.1; 294/94; 206/203

[58] Field of Search ..... 414/788.2, 795.6, 414/626, 908, 910, 802, 814; 294/87.1, 98.1, 94; 206/203, 505, 509, 511, 518; 220/513, 514, 516, 519

[56] References Cited

U.S. PATENT DOCUMENTS

| | | | |
|---|---|---|---|
| 3,574,381 | 4/1971 | Ocheltree et al. | 294/94 X |
| 3,780,492 | 12/1973 | Corderoy | 294/98.1 X |
| 3,945,486 | 3/1976 | Cooper | 294/98.1 X |
| 4,572,355 | 2/1986 | Hunter | 294/94 X |
| 4,700,837 | 10/1987 | Hammett | 206/203 X |
| 5,230,601 | 7/1993 | Apps et al. | 414/788.2 X |
| 5,421,477 | 6/1995 | Hammett | 206/203 X |
| 5,495,945 | 3/1996 | Apps et al. | 220/516 X |
| 5,855,277 | 1/1999 | Apps et al. | 206/203 X |

FOREIGN PATENT DOCUMENTS

| | | | |
|---|---|---|---|
| 74964 | 11/1952 | Denmark | 294/98.1 |
| 1121975 | 7/1968 | United Kingdom | 294/98.1 |
| 94/07758 | 4/1994 | WIPO . | |

*Primary Examiner*—Gregory A. Morse

*Attorney, Agent, or Firm*—Sughrue, Mion, Zinn, Macpeak & Seas, PLLC

[57] ABSTRACT

A method of handling containers, for instance beverage containers, such as bottles, flasks, cans, etc. that shall be distributed to retailers in shallow trays suitable for display purposes. The trays are constructed to enable several container-loaded trays to be stacked one upon the other. Container-loaded trays are lifted by moving a number of carrier-supported grippers (9) into a corresponding number of upwardly open holes (6) provided in the tray in interspaces between the containers. The lifting devices are brought into engagement with the walls defining the holes and the tray can then be lifted and handled with the tray suspended by the carrier (8).

20 Claims, 7 Drawing Sheets

STACKABLE TRAY FOR HOLDING, DISPLAYING, AND TRANSPORTING A PLURALITY OF CONTAINERS AND LIFTING DEVICE AND METHOD OF HANDLING DIRECTED THERETO

BACKGROUND OF THE INVENTION

The present invention relates to a method of handling containers, for instance beverage containers, such as bottles, flasks, cans etc., that are to be distributed to retailers in shallow trays which are suitable for displaying the containers and which enable several trays to be stacked one upon the other in layers. The invention also relates to a tray and to a lifting device for use when carrying out the method.

Efforts are constantly being made in the brewery industry, among others, for more rational methods of increasing productivity. The customers, normally retailers, place demands on flexibility when ordering different items of goods and wish for the goods to be delivered in a manner which displays the goods to their customers in turn.

For instance, there is a general wish for beverage containing bottles to be delivered in shallow trays which can be stacked one upon the other and in which the bottles can be clearly seen, instead of using deep crates. In this regard, it is also desired that stacks of mutually different sorts of beverages can be loaded onto a pallet, e.g. a three-stack pallet.

Beverage containing bottles for instance are normally handled in breweries in deep boxes or crates, therewith making it necessary to transfer the bottles into trays of a kind in which the bottles are suitably displayed. This constitutes an expensive procedure at present day costs.

In order to facilitate handling stacks of present day trays, it is necessary first to place respective stacks on a small "slave pallet" and then place this slave pallet on a pallet of standard size. This is necessary because, among other things, the trays are so weak that a stack corresponding, for instance, to half the size of a standard pallet or to a third of the size of a pallet cannot be lifted solely by applying a lifting force to the bottom most tray. Consequently, it is necessary to lift the stack with the aid of a separate slave pallet adapted to the stack. Handling of such a stack in a brewery with the aid of a pallet trolley or the like is also problematic because of the instability of the stack.

SUMMARY OF THE INVENTION

The prime object of the present invention is to provide a technique whereby containers, particularly brewery-handled beverage containers, can be handled in a simple, rational and reliable manner that does not require containers to be moved from crate to tray and vice versa, and that will also enable a stack of trays and containers to be handled effectively and smoothly in a brewery and that will facilitate loading of a pallet with stacks that contain mutually different products.

Accordingly, a method of the kind defined in the first paragraph is characterized in accordance with the present invention in that a container-loaded tray is lifted by inserting a plurality of carrier-supported lifting devices into a corresponding number of upwardly open holes in the tray located in the interspaces between the containers, and bringing the lifting devices into engagement with respective hole-defining walls and thereafter lifting the tray and handling said tray with the tray suspended beneath the carrier.

Among other things, this enables the container-loaded tray to be lifted with the aid of lifting devices that require no space outside the tray perimeter, therewith enabling such a tray to be placed closely adjacent to one another on a loading pallet.

Lifting of a stack of container-loaded trays is preferably achieved by bringing the lifting devices into engagement with mutually sequential, through-penetrating holes in the tray and into engagement with respective hole-defining walls in each tray.

This technique enables a stack of any chosen height to be lifted and handled without the use of a slave pallet, even when using thin-wall trays. This is made possible as a result of the distribution of the lifting force between the trays such that each tray will support its own load. Furthermore, the stack will hang from the carrier and be guided totally by the lifting devices, therewith obviating the risk of the stack toppling.

In a particularly preferred embodiment, the lifting devices are brought into engagement with the defining walls of respective holes by means of an element which is expanded into pressing engagement with said hole-defining walls.

A tray and a lifting device for carrying out the inventive method have the special characteristic features set forth in the following claims.

The invention will now be described in more detail with reference to exemplifying embodiments thereof and also with reference to the accompanying drawings.

DETAILED DESCRIPTION OF THE PREFERRED EMBODIMENT

Figure 1:
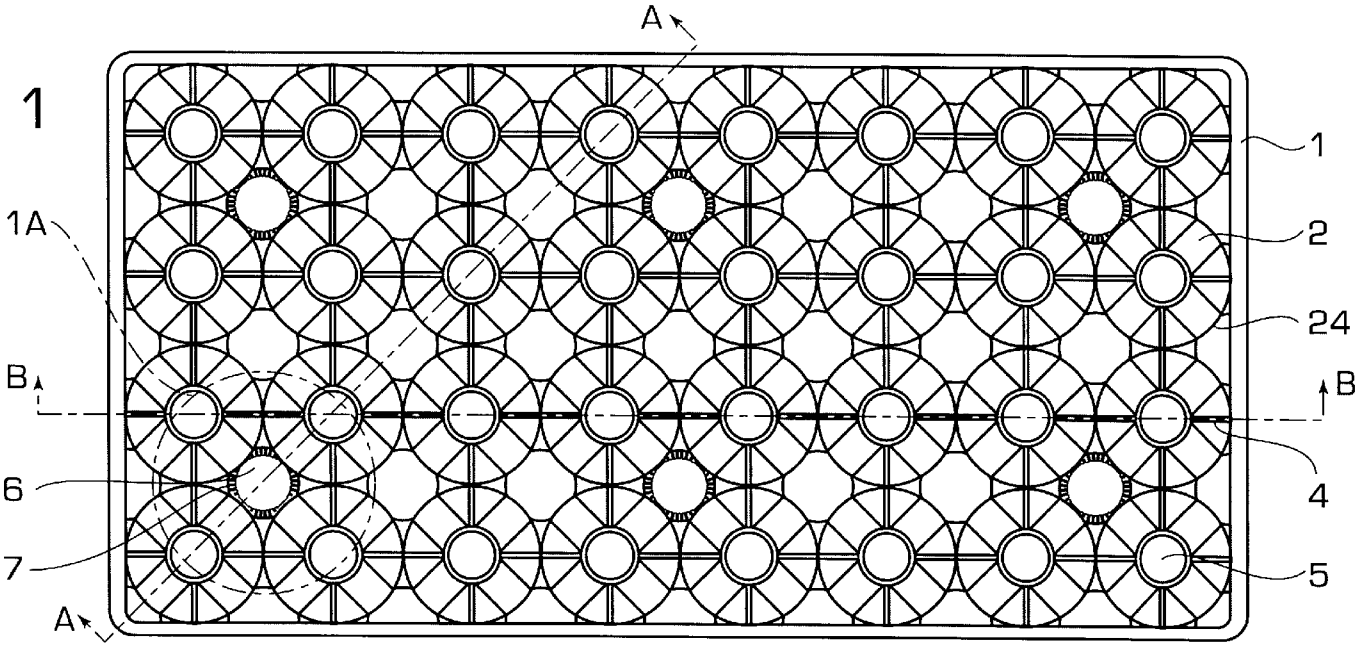
FIG. 1 illustrates the bottom of an inventive tray.
Figure 1A:
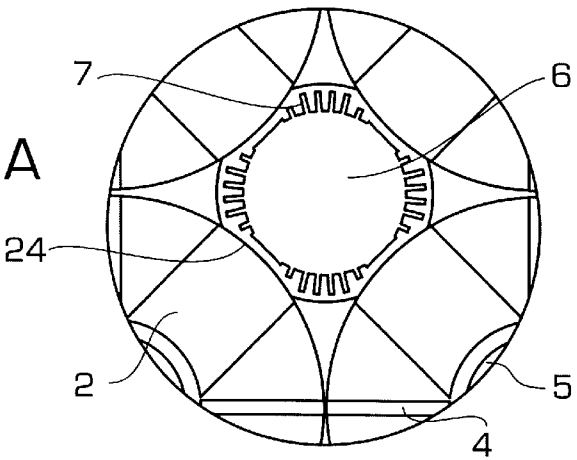
FIG. 1A illustrates part of the bottom shown in FIG. 1 in larger scale.

The reference numeral 1 in FIG. 1 identifies the perimeter wall of a shallow bottle-receiving plastic tray. The tray may be injection moulded from plastic material, for instance from crushed or ground plastic bottles. The illustrated tray includes 4×8 seats 2 for receiving bottles 3, see also FIG. 2 for instance. The seats 2 have the form of thin-wall cylindrical cups 24 which may be stiffened with the aid of a lattice of stiffening ribs 4, among other things. The cups 24 need not be all surrounding, but may be comprised of four mutually separated sections of a cylindrical wall. The trays are constructed in a manner which will enable empty stacks to be nested one in the other.

Each seat 2 has a centre hole 5. When stacking together several tiers of bottle-containing trays, the heads or capsules of bottles 3 located in a lower tier or layer are able to project up and support against the bottoms of bottles in the overlying tier.

Disposed in the spaces between diagonally situated seats 2 are through-penetrating holes 6 of which some, at least four and in the FIG. 1 embodiment six, are evenly distributed from the aspect of equilibrium and which are provided with reinforced wall-parts 7. These reinforcements comprise reinforcing ridges which extend in the longitudinal direction of the holes and are required particularly along those parts of the holes 6 that are not delimited by the cylindrical cups 24 of the seats 2. These cups may possibly have sufficient rigidity in themselves, since they are supported by bottles 3 placed in the seats 2. The holes 6 can be given a circular shape with the aid of the reinforcing elements 7, which is beneficial for reasons that will be explained below. However, the reinforcing element may alternatively have some other configuration, provided that this other configuration will not complicate manufacture.

The described tray may conveniently be dimensioned to enable two or three trays to be placed on a EUR-pallet, therewith enabling three different sorts of beverage to be displayed on one single pallet in a store or shop for instance. Because of the low height of sides 1 of the tray, essentially all bottles 3 will be presented for view in an attractive manner.

Figure 2:
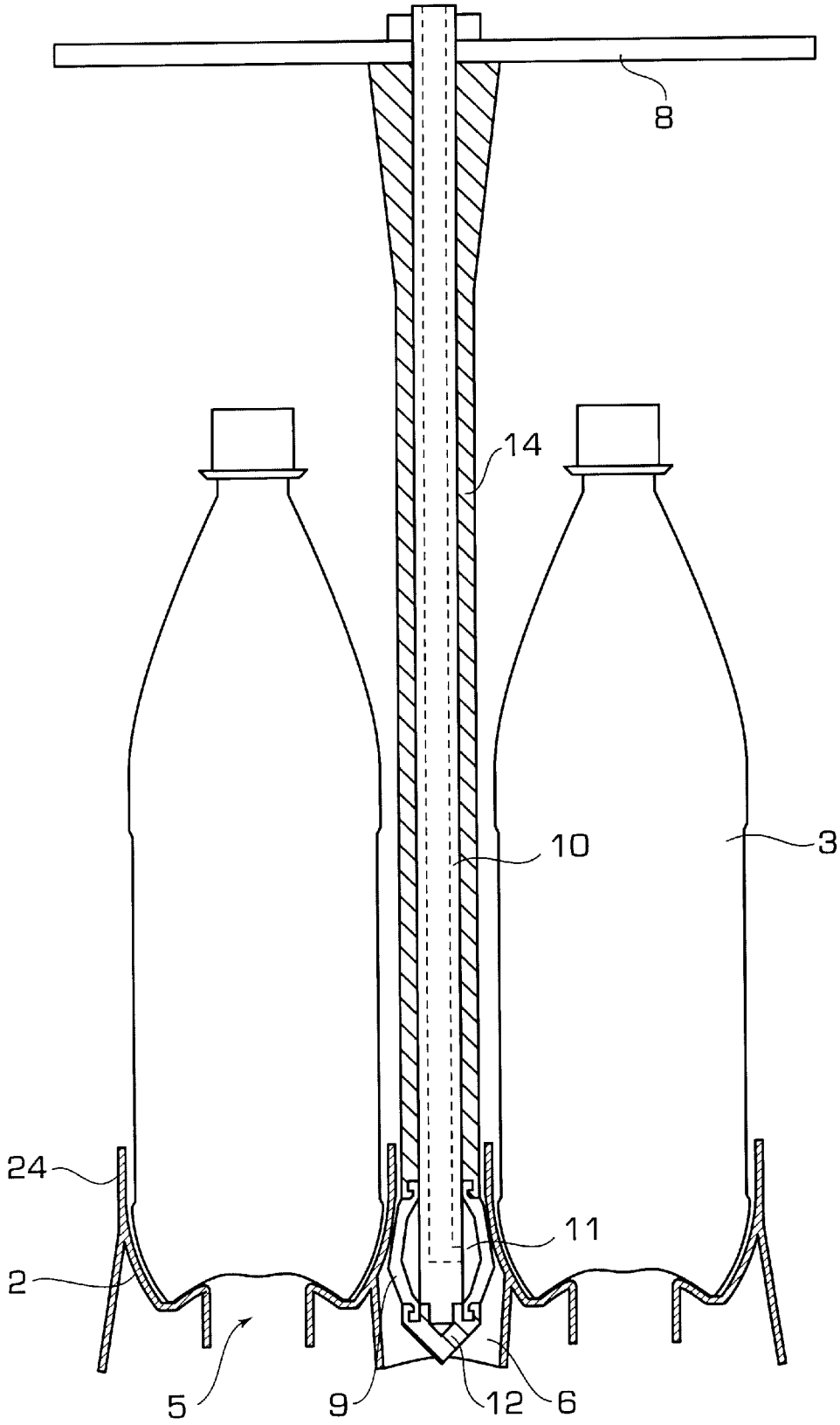
FIG. 2 is a sectional view of the tray in FIG. 1 taken on the line A—A in said Figure and illustrates bottles seated in the tray with said tray hanging from a lifting device.
Figure 4:
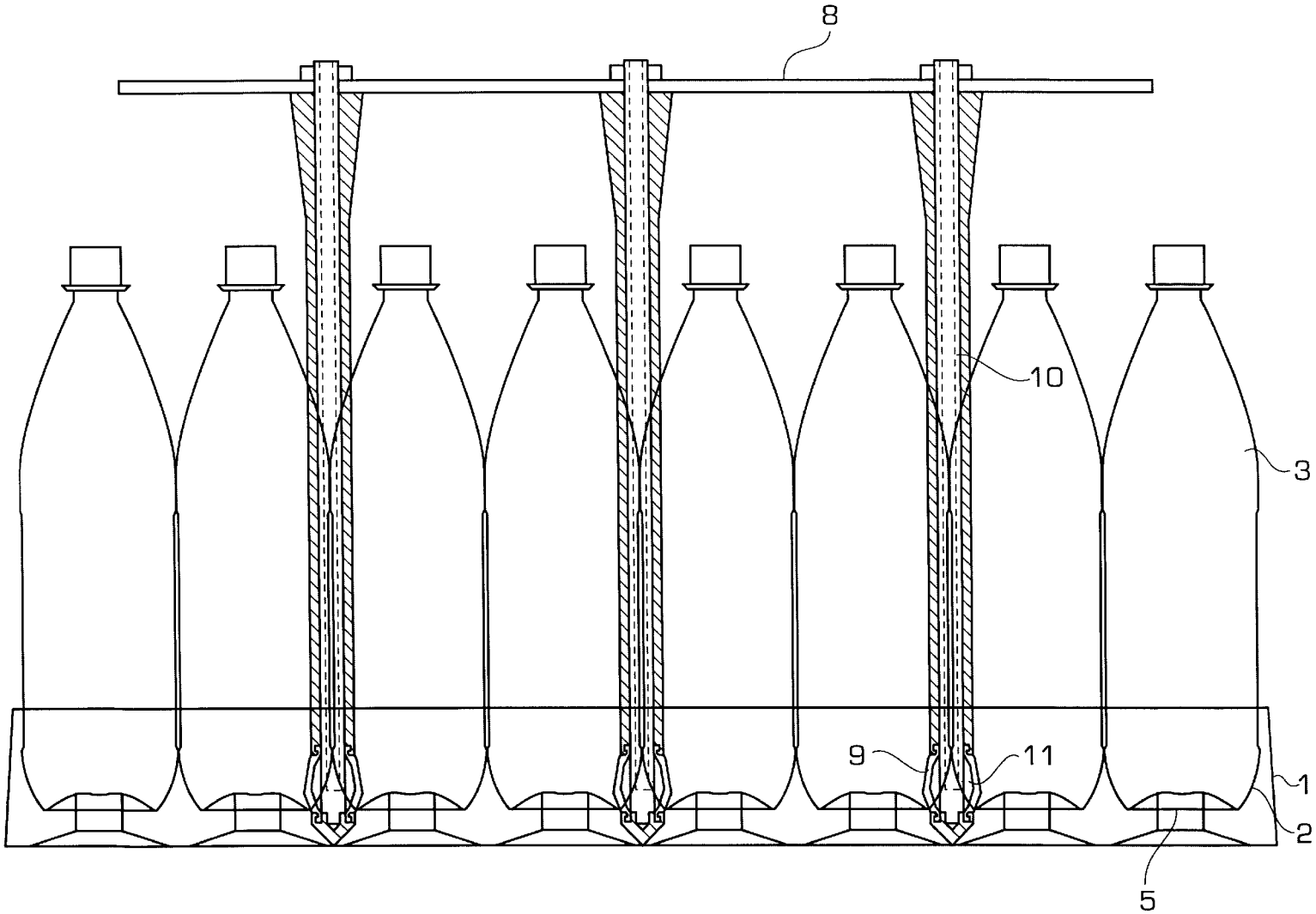
FIG. 4 is a sectional view taken on the line B—B in FIG. 1 and illustrating part of a tray filled with bottles.

As will be seen from FIGS. 2 and 4 for instance, a tray of the aforedescribed kind is handled in a brewery by lifting the tray with the aid of lifting devices suspended from a carrier means 8. The lifting devices have the form of rods 13 that can be moved down into the spaces formed diagonally between the bottles 3 and into the holes 6 of respective trays. The rods 13 are provided with grippers 9 for coaction with the walls defining respective holes 6.

The gripper of the FIG. 2 embodiment is comprised of a rubber cuff 9 disposed around a tube 10. Compressed air can be delivered through the tube 10 to a sealed space 11 in the cuff 9, so as to expand the cuff into abutment with its respective hole-defining wall.

The hole 6 suitably has an upwardly tapering shape, which is generated automatically when the hole is delimited by the bottle seats 2. Alternatively, the hole may be provided at its upper end with inwardly projecting flanges or the like.

Very frequent re-use of the trays in conjunction with fast working lifting devices will subject the trays to heavy loads as seen totally and also to a great deal of wear. This also applies to the grippers 9. Because the tray is comprised generally of very thin walls, it is therefore necessary with this in mind to reinforce those holes 6 that are to serve as lifting holes. As described above, reinforcement of said holes is conveniently achieved with the aid of reinforcing ridges 7 or the like which extend in the longitudinal direction of the holes along at least those parts of those holes 6 that are not delimited by adjacent bottle receiving seats 2. The cylindrical shape of the holes 6 that can be obtained hereby results in a considerable reduction in wear on the rubber cups 9, since it is therewith unnecessary for different parts of the cuffs to expand into the essentially wedge-shaped recesses formed between the walls of the bottle seats 2, in different working operations.

FIGS. 2 and 4 show the grippers 9 in their active modes, i.e. the tray concerned hangs from the carrier 8 and can be maneuvered as desired with no part of the tray protruding beyond the tray perimeter. This enables the trays to be placed close together on a pallet, among other things.

Figure 3:
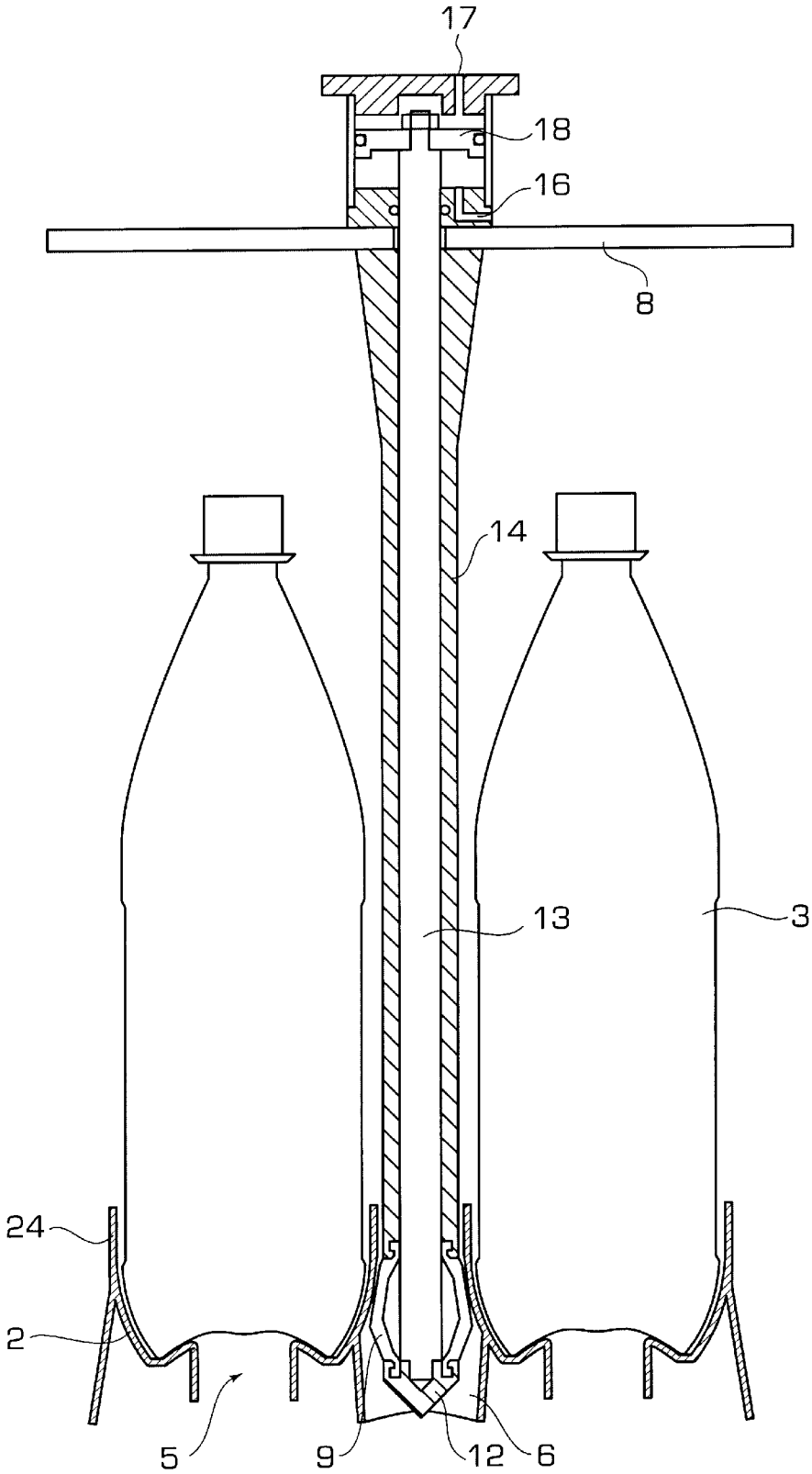
FIG. 3 is a view corresponding to the view of FIG. 2 but showing an alternative embodiment of the lifting device.

FIG. 3 illustrates an alternative method of expanding a gripper 9. In this case, there is provided a lower, suitably conical rubber-cuff clamping ring 12 is mounted on a rod 13 that can be moved up and down relative to an outer tube 14 to which the upper end of the rubber cuff 9 is sealingly affixed. The rod 13 can be maneuvered with the aid of compressed air, which is delivered and evacuated through supply and exhaust passages 16 and 17 on respective sides of a plunger 18 connected to the rod 13.

FIG. 3 illustrates the state of the arrangement in which the plunger 18 has lifted the rod 13 and the rubber cuff 9 has therewith been compressed axially so as to expanded radially into pressing abutment with the walls of the conical hole 6. The tray can thus be lifted with the aid of the carrier 8.

The tray is released by driving the plunger 18 downwards, therewith forcibly moving the rubber cuff 9 out of engagement with the hole-defining walls.

Figure 5:
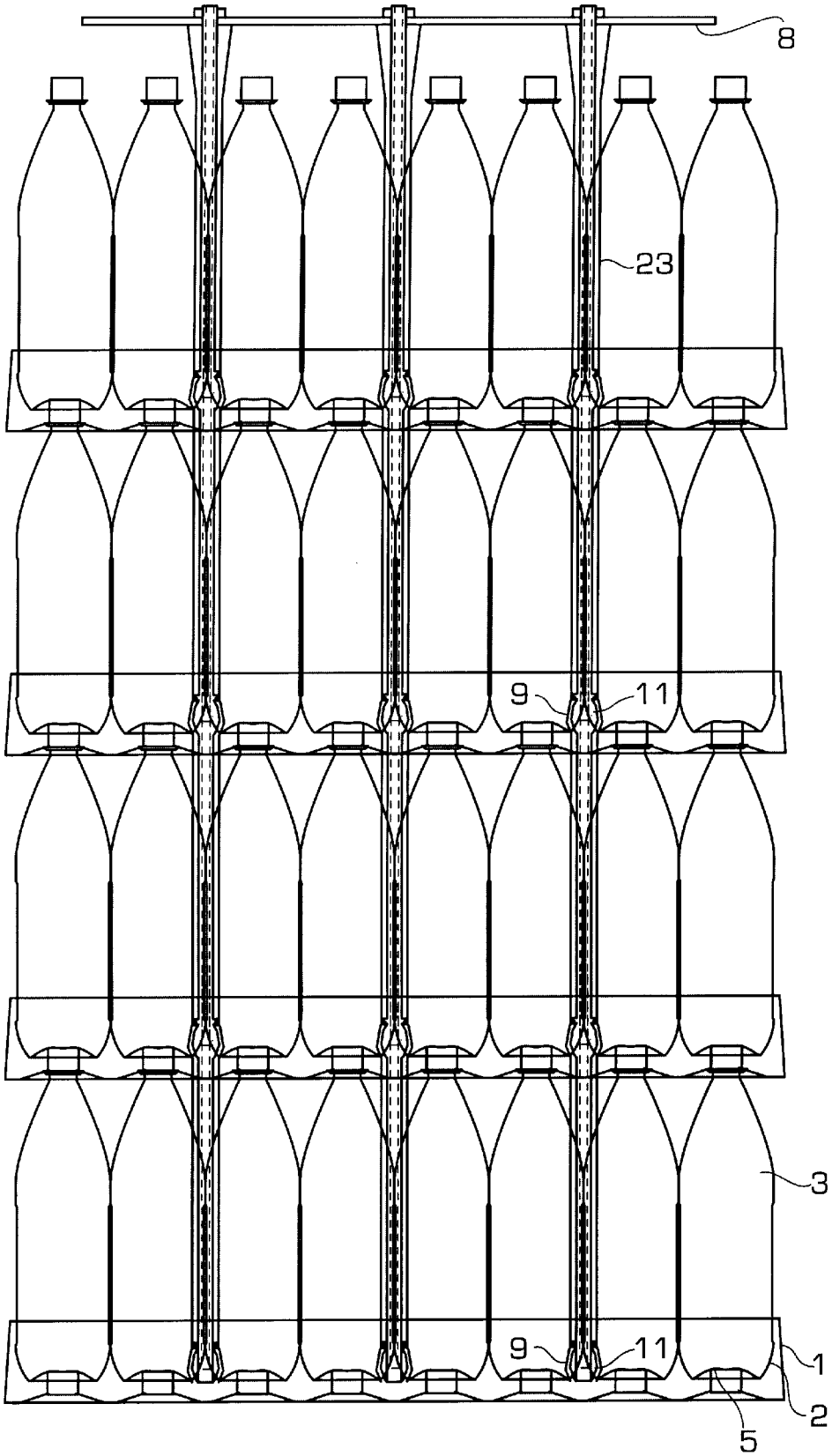
FIG. 5 is a section view corresponding to the view of FIG. 4 showing a stack of bottle-containing trays.

FIG. 5 illustrates how the lifting principle described with reference to FIGS. 2 and 4 can be used to lift a complete stack of bottle-containing trays.

The lifting holes are provided in the trays so as to be located in register with one another and therewith form a hole which penetrates through the entire stack. By constructing the lifting device in the form of a rod 23 provided with grippers 9 and passing through said hole, for instance with the design illustrated in FIG. 2, at the levels of the holes 6 through respective trays, the entire stack can be lifted without needing to use a bottom slave pallet or the like. This is made possible because the trays are lifted by associated grippers 9, therewith enabling each tray to support its own weight. The bottom tray will not therefore be subjected to any greater load than any of the other trays.

When using grippers of the kind illustrated in FIG. 2 for instance, all grippers will operate essentially in synchronism with one another when delivering compressed air thereto.

Figure 6:
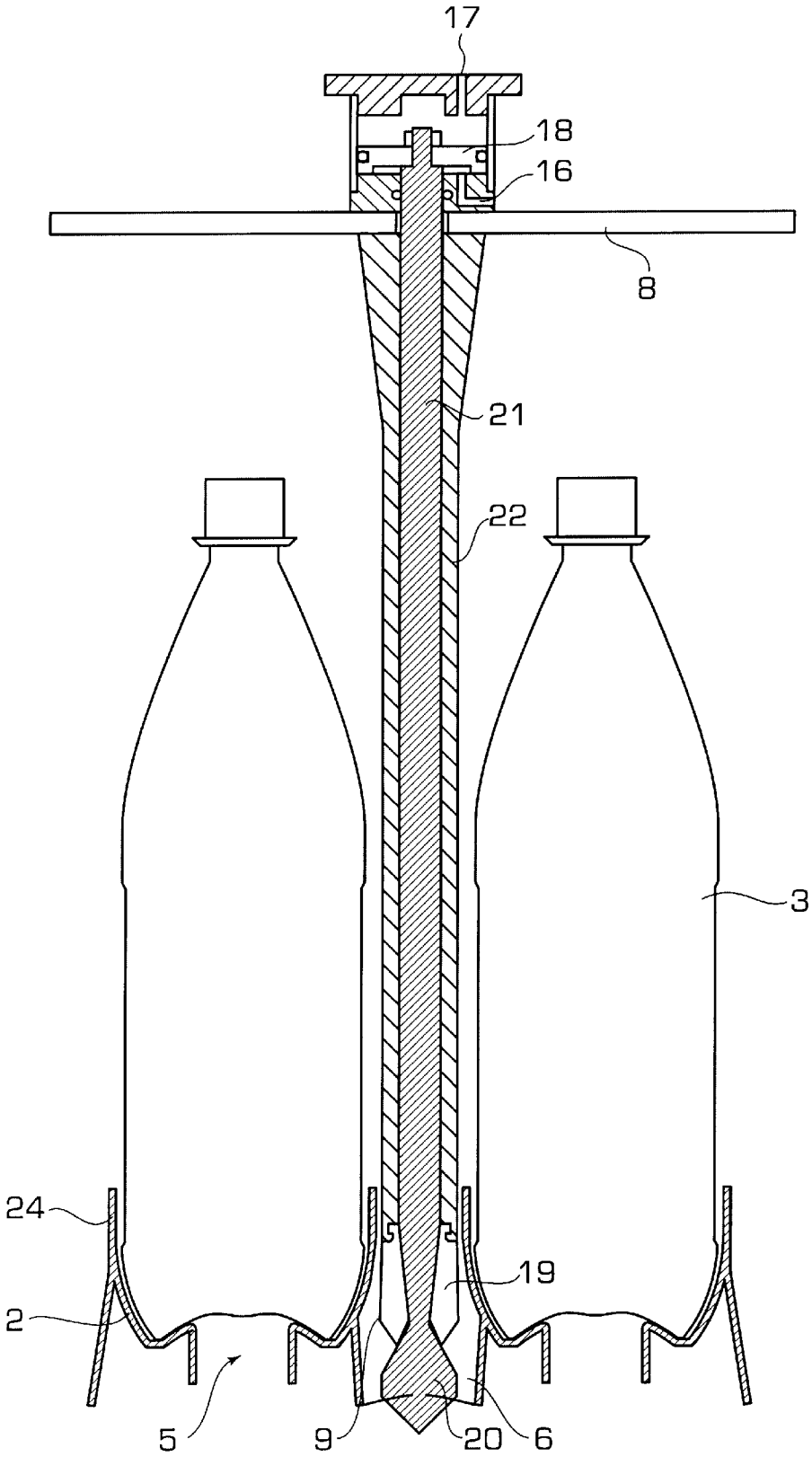
FIGS. 6 and 7 are views corresponding to the view of FIG. 2, showing another embodiment of the lifting device with the lifting devices inserted in respective lifting positions.
Figure 7:
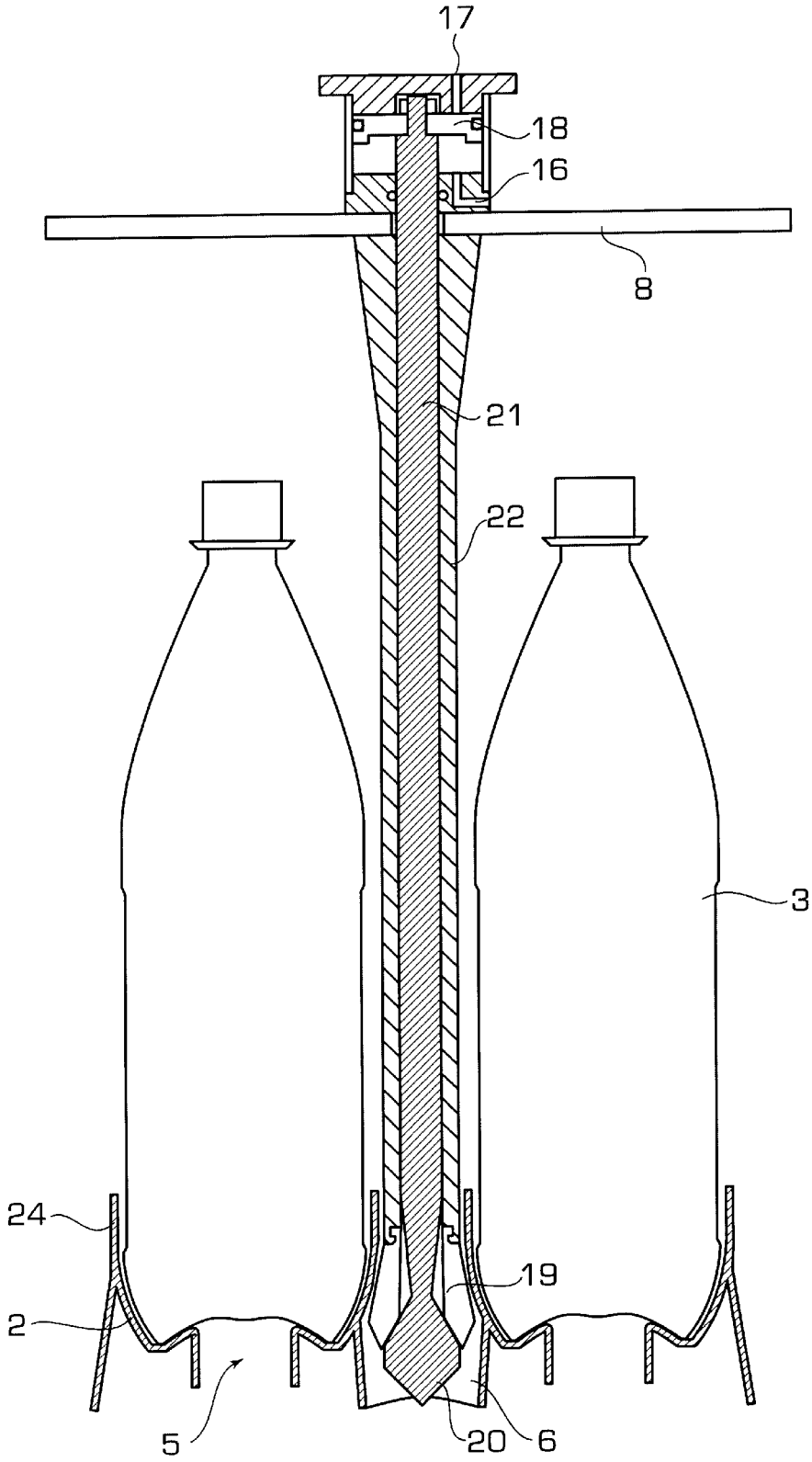

It will be understood that the rubber cuffs can be replaced with expandable grippers in the form of plastic sleeves or the like for instance. One such gripper is illustrated in FIGS. 6 and 7. The gripper of this embodiment comprises a slotted plastic sleeve 19 which is mounted on a tube 22 and which can be caused to expand through the medium of a conical member 20 made of steel or some like material. The conical member 20 can be driven with the aid of a plunger 18 in a corresponding manner to the bottom clamping ring 12 of the FIG. 3 embodiment. FIG. 6 illustrates the plunger 18 in its bottom position, in which the plastic sleeve 19 is out of contact with the hole-defining walls 6.

FIG. 7 shows the plunger 18 in its upper position, to which it has been pressed with the aid of compressed air delivered via the passage 16. The conical member 20 has thus been pulled up by the rod 21, causing the plastic sleeve 19 to expand into engagement with the defining walls of the hole 6. The tray can therewith be lifted by the carrier 8 and handled as desired.

As will be understood, the rod of this embodiment can be lengthened so as to extend through a complete stack of trays wherewith it includes a conical member 20 which is adapted to coact with an expansion sleeve 19 at those levels which correspond to the levels of the holes 6 in respective tiers of trays.

An important advantage afforded by the invention is that when handling a complete stack of trays, the trays are forcibly held in their correct positions relative to one another without risk of the stack toppling. When placing several stacks adjacent one another on a loading pallet, for instance three stacks, the stacks can be locked effectively in relation to one another by pressing down an empty tray centrally over some of the upper bottles in the stacks. This empty tray will bind the stacks together, therewith greatly increasing stability.

The invention enables bottles and the like to be handled directly in breweries with the aid of said trays, therewith eliminating the need for conventional crates and bottle plucking stations. As a result of the simplified handling of stacks of trays filled with ready-capped bottles, stacks of different sorts can be readily mixed on pallets in accordance with the wishes of the retail customer. Furthermore, bottles may be placed in trays constructed in accordance with the invention directly from the bottle manufacturing line and delivered in this way to the breweries. This will save otherwise necessary packaging while simplifying handling in the brewery.

Although the invention has been described with reference to exemplifying embodiments thereof it will be understood that modifications can be made in several respects within the scope of the following claims. A common feature of all tray embodiments is that even trays that have low outer walls which do not extend to a height that enables the walls to be gripped at those levels at which the bottles taper off can be gripped and lifted with the aid of grippers that can be moved down into holes in the tray and which require no space outside the tray defining walls. The shape and number of the holes can be varied as desired. Different types of grippers may also be used, provided that the grippers can be operated quickly and reliably, with small wear on both grippers and trays.

What is claimed is:

1. A method of handling containers disposed in seats formed in a shallow tray that will suitably display the containers and that will enable several tiers of shallow trays containing said containers to be stacked one on the other, said method comprising:

inserting lifting devices down into a corresponding number of through-holes formed in said shallow tray containing said containers, said through-holes formed between at least some of said seats and formed to taper radially outwardly along at least a longitudinal portion of said through-holes from a top of said through-holes to a bottom of said through-holes;

engaging said lifting devices with walls of said through-holes of said shallow tray containing said containers; and lifting said shallow tray containing said containers.

2. A method according to claim 1, wherein a stacked plurality of shallow trays containing said containers are stacked such that said through-holes of each of said shallow trays containing said containers are coaxially aligned with said through-holes of the other of said stacked plurality of shallow trays containing said containers, said method further comprising:

engaging said lifting devices with walls of said through-holes in at least a bottom shallow tray of said stacked plurality of shallow trays containing said containers.

3. A method according to claim 1, wherein said engaging step further comprises expanding an element disposed on said lifting devices into engagement with said walls of said through-holes.

4. A tray for handling commonly a plurality of containers, comprising:

a plurality of shallow seats for receiving said plurality of containers, said plurality of shallow seats being evenly distributed over said tray; and a plurality of through-holes in interspaces between said shallow seats, said through-holes being situated diagonally between said seats, and said through-holes tapering radially outwardly along at least a portion of said through-holes in a longitudinal direction of said through-holes from a top of said through-holes to a bottom of said through-holes.

5. A tray according to claim 4, wherein said through-holes are, from a weight equilibrium aspect, distributed evenly over the tray.

6. A tray according to claim 4, wherein each through-hole is surrounded by four adjacent ones of said shallow seats.

7. A tray according to claim 6, wherein an upper portion of said through-holes are provided with flange-like projections.

8. A tray according to claim 4, wherein said tray is a thin-walled plastic structure, and wherein said shallow seats have respective central openings dimensioned to allow heads of containers in a lower tray forming a first tier to project up through said respective central openings to contact bottoms of containers in said tray, which forms an immediately overlying tier with respect to said lower tray.

9. A tray according to claim 6, wherein said through-holes comprise reinforcing wall-parts extending along a longitudinal direction of at least a portion of each of said through-holes.

10. A tray according to claim 9, wherein each through-hole is delimited by four surrounding shallow seats and wherein said through-holes comprise reinforcing wall-parts extending along a longitudinal direction of at least a portion of each of said through-holes.

11. A lifting device for use in handling a tray according to claim 4, wherein said lifting device comprises:

a rod insertably provided for said through-holes in said tray and comprises at least one gripping element disposed at an end portion of said rod, said gripping element adapted to adopt either of a first retracted position and a second extended position, said retracted position corresponding to a state wherein said gripping element has a diameter smaller than said through-holes and said second extended position corresponding to a state wherein said gripping element contacts inner wall portions of said through-holes.

12. A lifting device according to claim 11, wherein a plurality of gripping elements are provided at points along said rod corresponding to positions of said through-holes of each tray of a stack of container-loaded trays, and wherein said gripping elements can be actuated for simultaneous engagement with all trays in said stack.

13. A lifting device according to claim 12, wherein said gripping element comprises a rubber cuff that can be expanded to said second extended position by one of compressed air and mechanical means for expanding said rubber cuff.

14. A lifting device for use in handling a tray, wherein said tray is designed to commonly handle a plurality of containers, wherein said tray comprises a plurality of shallow seats, for receiving said plurality of containers, and a plurality of through-holes situated in interspaces between said shallow seats, wherein said lifting device comprises:

a rod insertably provided for said through-holes in said tray, said rod comprising a plurality of gripping elements provided at points along said rod corresponding to positions of said through-holes of each tray of a stack of container-loaded trays, wherein said gripping elements can be actuated for simultaneous engagement with all trays in said stack, and wherein said gripping elements are adapted to adopt either of a first retracted position and a second extended position, said retracted position corresponding to a state wherein said gripping element has a diameter smaller than said through-holes and said second extended position corresponding to a state wherein said gripping element contacts inner wall portions of said through-holes.

15. A thin-walled tray for holding a plurality of containers, comprising:

a plurality of substantially cylindrical seats, and a plurality of lifting holes formed to extend through said tray at predetermined positions between at least some of said plurality of substantially cylindrical seats, said plurality of lifting holes tapering radially outwardly along at least a portion of said lifting holes in a longitudinal direction of said lifting holes from a top of said lifting holes to a bottom of said lifting holes, wherein a bottom portion of each of said substantially cylindrical seats further comprises an annular depression defining a seat hole in a center portion of said bottom portion.

16. A tray according to claim 15, wherein said lifting holes are evenly distributed over said tray.

17. A tray according to claim 16, wherein each of said lifting holes is disposed between four adjacent substantially cylindrical seats.

18. A tray according to claim 17, wherein said lifting holes are longitudinally reinforced along at least a portion of said lifting holes.

19. A tray according to claim 17, wherein the longitudinal reinforcement comprises a plurality of reinforcing ridges disposed along at least a portion of said lifting holes.

20. A tray for handling commonly a plurality of containers, said tray adapted to enable a plurality of container-loaded trays to be stacked one upon the other, said tray comprising:

a plurality of upwardly open holes, which are situated in interspaces between seats of said tray, each of said seats configured to retain a container;

wherein said tray is a thin-walled plastic structure, and wherein each of said seats has a central opening dimensioned to allow heads of containers in one tier to project up through said openings and support against bottoms of containers in an immediately overlying tier when a plurality of container-loaded trays are stacked one upon the other.

* * * * *